US008172932B2

(12) United States Patent
Oh et al.

(10) Patent No.: US 8,172,932 B2
(45) **Date of Patent: *May 8, 2012**

(54) CONNECTING TUBE HAVING DUST SENSING FUNCTION FOR USE IN VACUUM CLEANER

(75) Inventors: Jang-keun Oh, Gwangju (KR); Min-ha Kim, Gwangju (KR); Jin-gon Lee, Gwangju (KR); Jung-gyun Han, Gwangju (KR); Seung-yong Cha, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 638 days.

This patent is subject to a terminal disclaimer.

(21) Appl. No.: 12/008,296

(22) Filed: Jan. 10, 2008

(65) Prior Publication Data

US 2008/0250764 A1 Oct. 16, 2008

(30) Foreign Application Priority Data

Apr. 11, 2007 (KR) ..... 10-2007-0035434
Aug. 14, 2007 (KR) ..... 10-2007-0081738

(51) Int. Cl.
*B01D 50/00* (2006.01)

(52) U.S. Cl. ..... 96/382; 15/319; 15/339; 55/DIG. 3; 55/DIG. 34; 96/418

(58) Field of Classification Search ..... 96/418, 96/417, 421, 422; 15/319, 339
See application file for complete search history.

(56) References Cited

U.S. PATENT DOCUMENTS 4,767,213 A 8/1988 Hummel
(Continued)

FOREIGN PATENT DOCUMENTS

DE 102005023406 5/2006
(Continued)

OTHER PUBLICATIONS

Official Action dated Dec. 10, 2008 for corresponding Russian Patent Application No. 2007146233/12 (050669).

(Continued)

*Primary Examiner* — Duane Smith
*Assistant Examiner* — Thomas McKenzie
(74) *Attorney, Agent, or Firm* — Ohlandt, Greeley, Ruggiero & Perle, LLP

(57) ABSTRACT

A connecting tube having a dust sensing function is provided. The connecting tube includes a tube element having a first air flowing passage; a body having a second air flowing passage to communicate with the first air flowing passage; a detecting sensor disposed on the second air flowing passage to detect whether the dust or dirt passes through the second air flowing passage; a lamp part to operate according to a signal outputted from the detecting sensor; a rotating part rotatably disposed on the body; a rotation driving-passage part disposed on the body to draw in an external air into the second air flowing passage and thus to rotate the rotating part; an electric generator connected to the rotating part to generate an electric power; and a muffler part to reduce noises from the rotating part and the flowing air.

8 Claims, 6 Drawing Sheets

U.S. PATENT DOCUMENTS

| | | | | |
|---|---|---|---|---|
| 5,033,151 | A * | 7/1991 | Kraft et al. | 15/319 |
| 5,404,612 | A * | 4/1995 | Ishikawa | 15/319 |
| 5,572,767 | A * | 11/1996 | Ishikawa | 15/319 |
| 5,815,884 | A * | 10/1998 | Imamura et al. | 15/339 |
| 6,023,814 | A * | 2/2000 | Imamura | 15/339 |
| 7,562,414 | B2 * | 7/2009 | Oh et al. | 15/339 |
| 2006/0093501 | A1 | 5/2006 | Lee et al. | |

FOREIGN PATENT DOCUMENTS

| | | |
|---|---|---|
| EP | 0231419 | 8/1987 |
| EP | 0373353 | 6/1990 |
| JP | 62-217932 | 9/1987 |
| JP | 02-307428 | 12/1990 |
| JP | 05-285082 | 11/1993 |
| JP | 09-149871 | 6/1997 |
| JP | 9149871 | 6/1997 |
| JP | 09-327425 | 12/1997 |
| JP | 10-127542 | 5/1998 |
| JP | 10000174 | 6/1998 |
| JP | 11-076120 | 3/1999 |
| KR | 20-19930013057 | 7/1993 |
| KR | 100120616 | 8/1997 |
| KR | 100213497 | 5/1999 |
| KR | 1020040047368 | 6/2004 |

OTHER PUBLICATIONS

Extended European Search Report dated Apr. 13, 2010 for corresponding European Patent Application No. 08101321.1.

Japanese Office Action dated Jan. 5, 2010 for corresponding Japanese Patent Application No. 2008-007646.

* cited by examiner

CONNECTING TUBE HAVING DUST SENSING FUNCTION FOR USE IN VACUUM CLEANER

CROSS-REFERENCE TO RELATED APPLICATIONS

This application claims the benefit under 35 U.S.C. §119(a) from Korea Patent Application Nos. 10-2007-35434 and 10-2007-81738, filed on Apr. 11, 2007 and Aug. 14, 2007, respectively, in the Korean Intellectual Property Office, the entire disclosures of both of which are incorporated herein by reference.

BACKGROUND OF THE INVENTION

1. Field of the Invention

The present disclosure relates to a vacuum cleaner. More particularly, the present disclosure relates to a connecting tube having a dust sensing function for use in a vacuum cleaner, which can detect whether there is dust or dirt on a surface to be cleaned and inform a user of the detected result in cleansing.

2. Description of the Related Art

Generally, in cleaning, a vacuum cleaner generates a strong suction force by using a suction motor, so that it draws in dust or dirt from a surface to be cleaned thus to clean the surface to be cleaned. Accordingly, the vacuum cleaner is very useful in cleaning dust or dirt adhered to the surface to be cleaned, such as a carpet, a floor and the like.

However, when a user cleans the surface to be cleaned using the vacuum cleaner, she or he can easily perceive whether there is dust or dirt on the surface to be cleaned in a cleaning area contaminated or soiled with relatively large dust or relatively conspicuous dirt, but can not easily perceive whether there is dust or dirt on the surface to be cleaned in a cleaning area soiled with relatively minute dust.

To address the problem as described above, an electric vacuum cleaner in which a rotating blade and an electric generator driven by the rotating blade are installed on a dust suction passage, such as an extended tube or the like, is disclosed in Japanese Patent Laid-open No. H 11-76120. The rotating blade is rotated by an external air, which is drawn in due to an air suction force in the dust suction passage. The electric vacuum cleaner is configured, so that in cleaning, the electric generator driven by the rotating blade generates an electric power to operate a dust sensor and the like and thus the dust sensor informs a user of whether there is dust or dirt drawn in a suction nozzle or the dust suction passage in which it is installed. Accordingly, the user can perceive whether there is the dust or dirt on the surface to be cleaned or whether the dust or dirt is completely removed from the surface to be cleaned according to the operation of the dirt sensor in cleaning.

However, in the electric vacuum cleaner as described above, since the rotating blade driving the electric generator is rotated by the external air, which is drawn in due to the air suction force in the dust suction passage, there is a problem in that when the rotating blade is rotated by the external air and when the external air is mixed with air in the dust suction passage, noises can be generated. The noises may cause the vacuum cleaner to deteriorate in quality.

SUMMARY OF THE INVENTION

The present disclosure has been developed in order to solve the above problems in the related art. Accordingly, an aspect of the present disclosure is to provide a connecting tube having a dust sensing function for use in a vacuum cleaner capable of automatically detecting whether there is dust or dirt on a surface to be cleaned and informing a user of the detected result without generating large noises in cleaning.

The above aspects are achieved by providing a connecting tube having a dust sensing function for use in a vacuum cleaner, including: a tube element having a first air flowing passage therein to move drawn-in air laden with dust or dirt; a body connected to the tube element and having a second air flowing passage to communicate with the first air flowing passage; a detecting sensor disposed in the second air flowing passage of the body to detect whether the dust or dirt passes through the second air flowing passage; a lamp part to operate according to a signal outputted from the detecting sensor; a rotating part rotatably disposed in the body; a rotation driving-passage part disposed in the body to draw in an external air into the second air flowing passage from the outside by means of an air suction force in the second air flowing passage of the body and thus to rotate the rotating part; an electric generator connected to the rotating part to rotate by the rotating part thus to generate an electric power for operating the detecting sensor and the lamp part; and a muffler part disposed on the body to reduce noises generating in rotating of the rotating part and in flowing of air.

Here, the tube element may be a straight tube, a telescopic tube, or a flexible tube.

The body and the tube element may be detachably disposed on a suction nozzle and an operating handle, or the operating handle and a cleaner body, respectively. For this, preferably, but not necessarily, the body and the tube element include first and second connectors detachably connected to the suction nozzle and the operating handle, or the operating handle and the cleaner body, respectively.

The detecting sensor may be an optical sensor having a light-emitting part and a light-receiving part.

The lamp part may include a first lamp to operate according to a first signal generated when the detecting sensor detects the dust or dirt, and a second lamp to operate according to a second signal generated when the detecting sensor does not detect the dust or dirt.

The rotating part may be an impeller having a rotating axis disposed parallel to a longitudinal axis of the second air flowing passage of the body.

Preferably, but not necessarily, the rotation driving-passage part is formed to a rotating part-mounting part disposed on an outside of the body to mount the rotating part therein, and includes a plurality of suction openings formed on an outer circumferential surface of the rotating part-mounting part to draw in the external air, a rotating part-mounting space in which the rotating part is disposed and through which the external air moves via the rotating part, and a discharging tube part formed on a surface of the rotating part-mounting part to communicate with the second air flowing passage.

Preferably, but not necessarily, the muffler part includes a plurality of resonating holes formed in the body, and a noise-absorbing member filled in a space between a cover and the body.

BRIEF DESCRIPTION OF THE DRAWING FIGURES

The above aspects and other advantages of the present disclosure will be more apparent by describing exemplary embodiment of the present disclosure with reference to the accompanying drawing figures, in which.

Throughout the drawings, like reference numerals will be understood to refer to like parts, components and structures.

DETAILED DESCRIPTION OF AN EXEMPLARY EMBODIMENT

Hereinafter, a connecting tube having a dust sensing function for use in a vacuum cleaner according to an exemplary embodiment of the present disclosure will now be described in greater detail with reference to the accompanying drawing figures.

Figure 7:
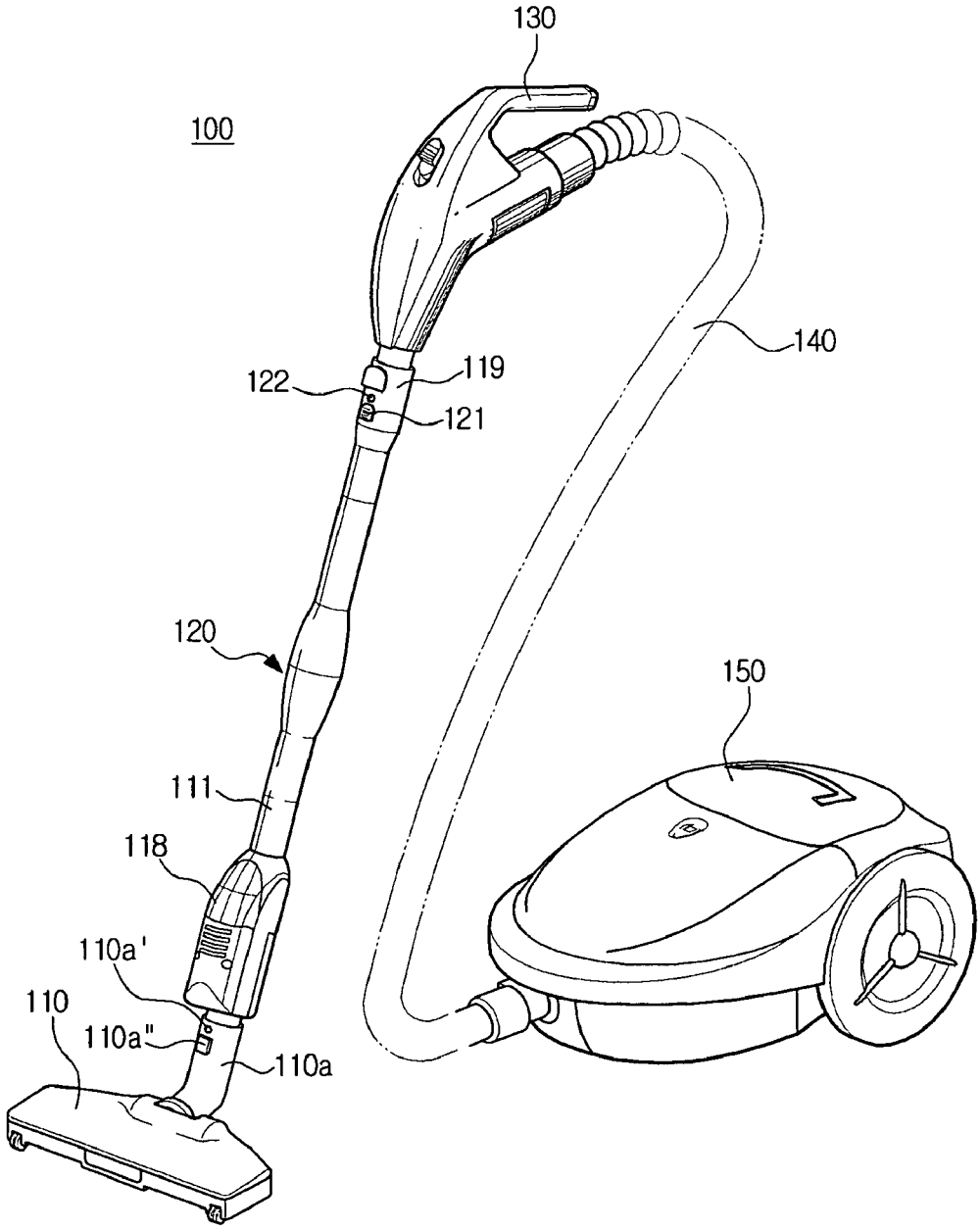
FIG. 7 is a perspective view exemplifying a vacuum cleaner to which the connecting tube having the dust sensing function according to the exemplary embodiment of the present disclosure is applied.

FIG. 7 is a perspective view exemplifying an example of a vacuum cleaner 100 to which a connecting tube 120 having a dust sensing function according to an exemplary embodiment of the present disclosure is applied Referring to FIG. 7, the vacuum cleaner 100 includes a suction nozzle 110 to draw in air laden with dust or dirt, a connecting tube 120 having the dust sensing function according to the exemplary embodiment of the present disclosure, an operating handle 130, a suction hose 140 connected to the operating handle 130, and a cleaner body 150 connected to the suction hose 140 and divided into a dust collecting chamber (not illustrated) and a motor chamber (not illustrated).

Figure 1:
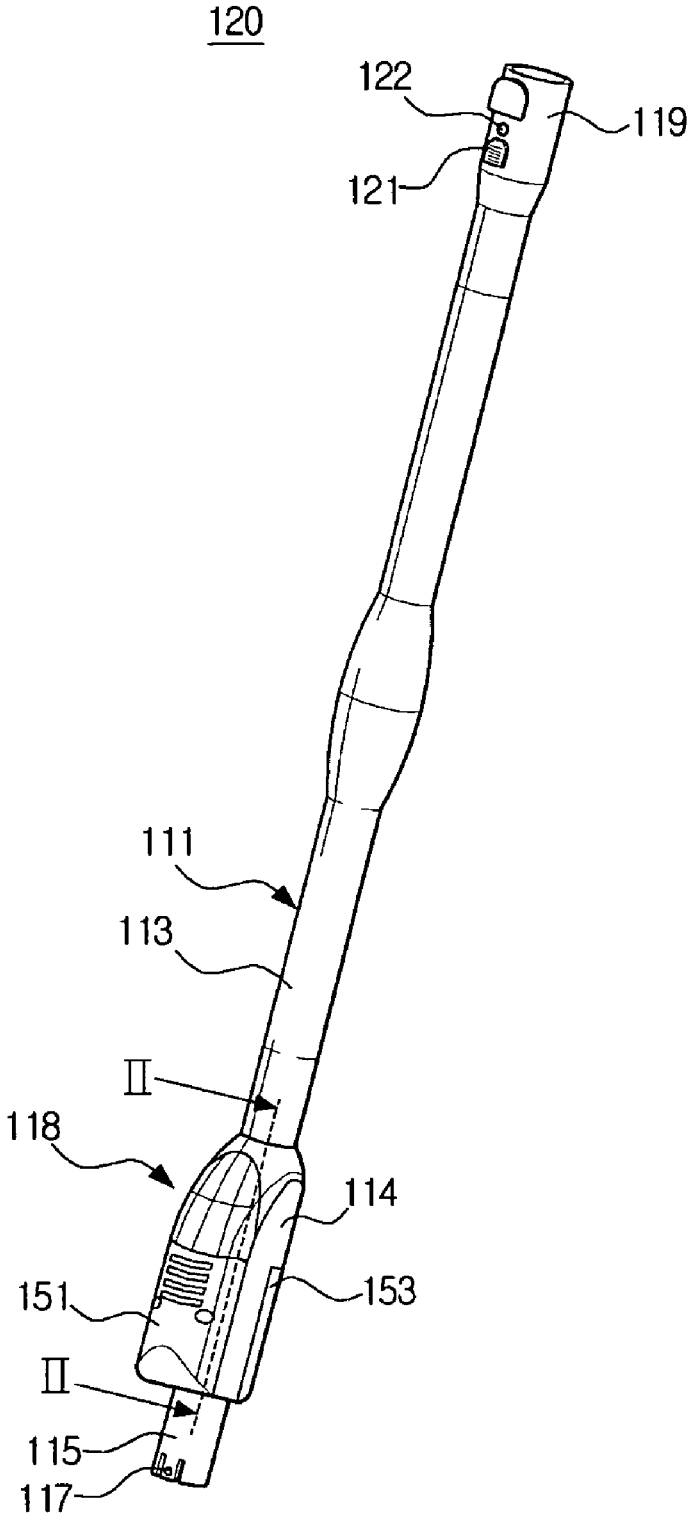
FIG. 1 is a perspective view exemplifying a connecting tube having a dust sensing function for use in a vacuum cleaner according to an exemplary embodiment of the present disclosure.

FIG. 1 is a perspective view exemplifying the connecting tube 120 having the dust sensing function for use in the vacuum cleaner according to the exemplary embodiment of the present disclosure.

As illustrated in FIGS. 1 and 7, the connecting tube 120 is detachably disposed between the suction nozzle 110 and the operating handle 130, and includes a tube element 111 and a dust sensing unit 118.

Figure 2:
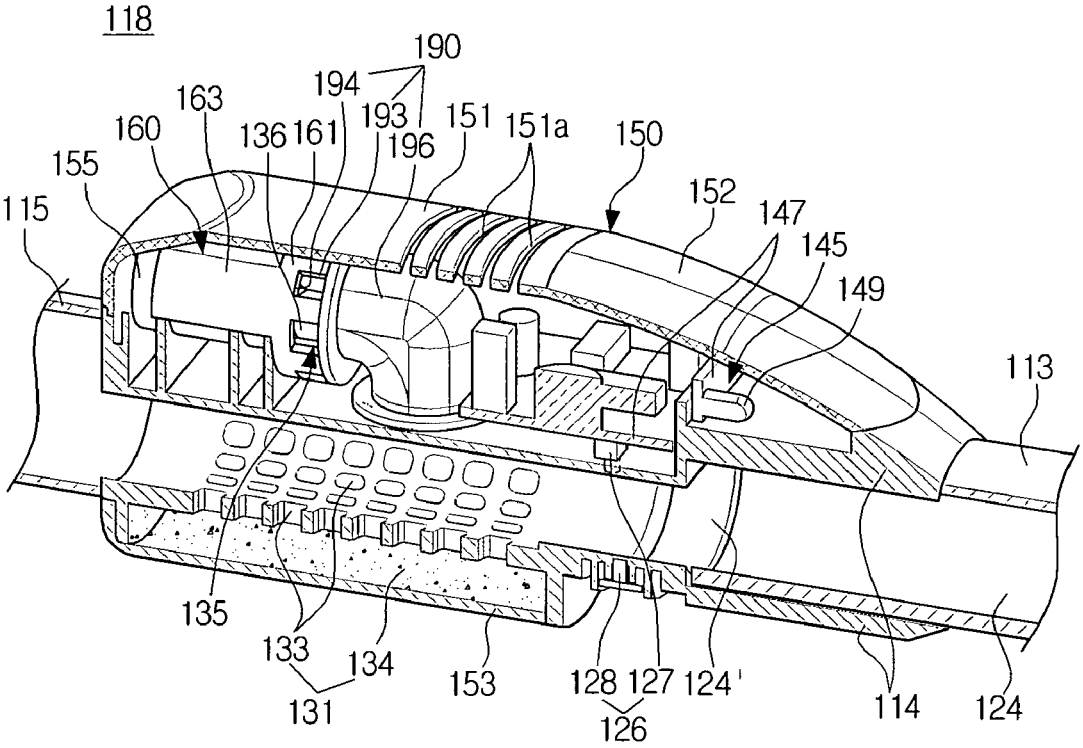
FIG. 2 is a partial cross-sectional perspective view of the connecting tube taken along line II-II of FIG. 1.

The tube element 111 is made up of a straight tube 113 in the form of a cylinder. The straight tube 113 has a first air flowing passage 124 therein as shown in FIG. 2. The first air flowing passage 124 communicates with the suction nozzle 110 and the operating handle 130 and moves suction air laden with dust or dirt drawn in through the suction nozzle 110 toward the operating handle 130 from the suction nozzle 110.

Figure 3:
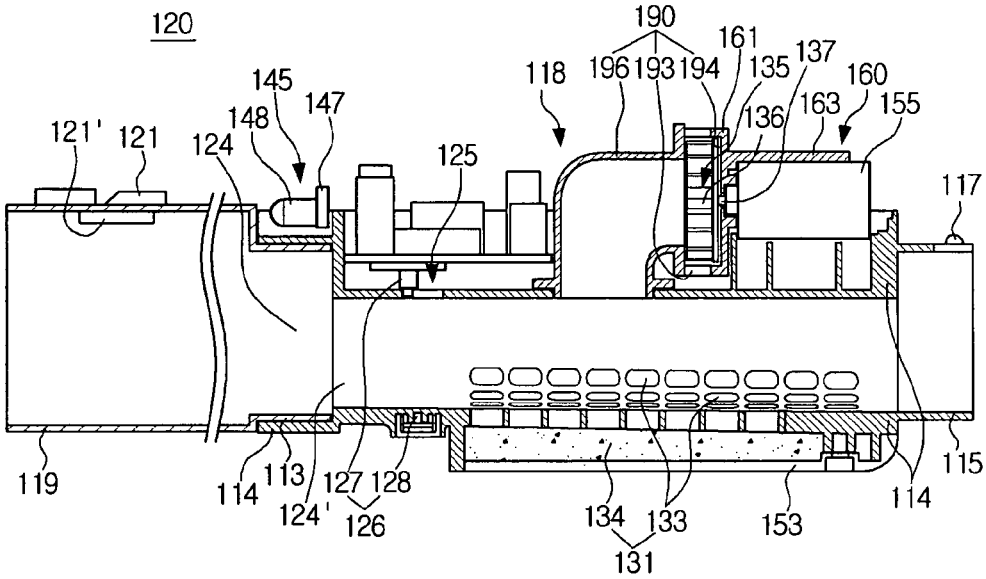
FIG. 3 is a cross-sectional view of the connecting tube illustrated in FIG. 1 from which an upper cover is omitted.

As illustrated in FIGS. 2 and 3, the dust sensing unit 118 includes a body 114, a detecting sensor 125, a lamp part 145, a rotating part 135, a rotation driving-passage part 190, an electric generator 155 and a cover part 150.

The body 114 at an upper part thereof accommodates and fixes the straight tube 113. The body 114 is formed of a rectangular parallelepiped tube. The rectangular parallelepiped tube has a second air flowing passage 124' in the form of a cylinder, which is communicated with the first air flowing passage 124 of the straight tube 113.

The detecting sensor 125, which detects whether there is dust or dirt in the air drawn in through the suction nozzle 110 when it passes through the second air flowing passage 124' in cleaning, is disposed at the entrance of the second air flowing passage 124'. The detecting sensor 125 may be an optical sensor 126 having a light-emitting part 127 and a light-receiving part 128. In this case, the light-emitting part 127 is installed in one surface of an upper part of the body 114 to emit light toward the second air flowing passage 124', and the light-receiving part 128 is installed in another surface opposite to the one surface of the upper part of the body 114 to receive the light passing though the second air flowing passage 124' after emitted from the light-emitting part 127. Accordingly, if there is dust or dirt in the air passing through the second air flowing passage 124', the light emitted from the light-emitting part 127 is blocked by the dust or dirt. As a result, the optical sensor 126 generates an OFF signal. To the contrary, if there is no dust or dirt in the air, the light-receiving part 128 receives the light emitted from the light-emitting part 127. As a result, the optical sensor 126 generates an ON signal.

The lamp part 145, which operates according to the signals from the detecting sensor 125 to inform a user of whether there is the dust or dirt in the air passing through the second air flowing passage 124' after being drawn in through the suction nozzle 110 in cleaning, is installed on a circuit board 147. The lamp part 145 is made up of first and second lamps 148 and 149. The first lamp 148 (FIG. 3) is operated by the OFF signal generating when the detecting sensor 125 detects the dust or dirt, and the second lamp 149 (FIG. 2) is operated by the ON signal generating when the detecting sensor 125 does not detect the dust or dirt. The first and the second lamps 148 and 149 are formed of laser emitting diodes (LEDs), which can emit red light and blue light by themselves, respectively. A transparent plate 152 is installed in an upper cover 151 of the cover part 150, which is located opposite to the first and the second lamps 148 and 149.

Figure 4:
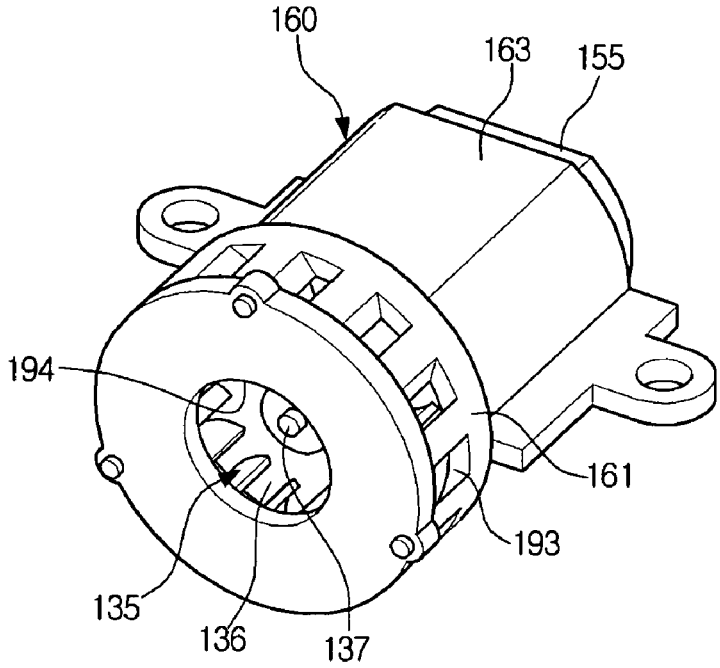
FIG. 4 is a perspective view of a generator bracket of the connecting tube illustrated in FIGS. 2 and 3.
Figure 5:
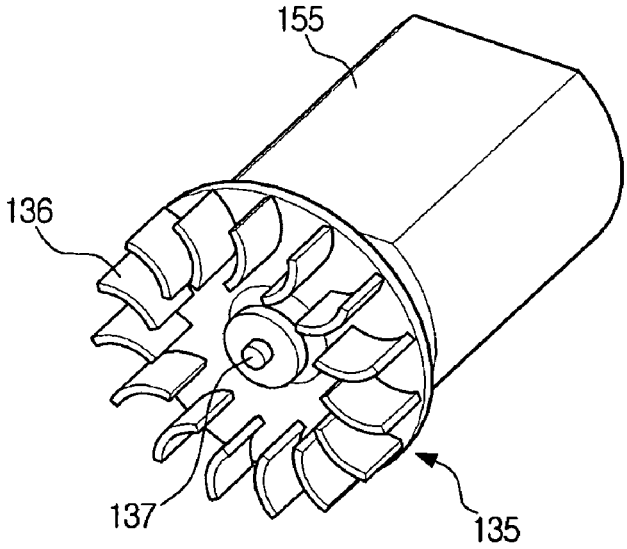
FIG. 5 is a perspective view of an impeller and an electric generator of the connecting tube illustrated in FIGS. 2 and 3.

The rotating part 135, which generates a rotating force to rotate a coil part (not illustrated) of the electric generator 155, is made up of an impeller 136. As illustrated in FIGS. 3 through 5, the impeller 136 has a rotating axis 137, which is connected on an axis of the electric generator 155 mounted on a generator mounting part 163 of a generator bracket 160. The rotating axis 137 of the impeller 136 is arranged parallel to a suction air flowing direction of the second air flowing passage 124', that is, a longitudinal axis of the second air flowing passage 124'.

The rotation driving-passage part 190, which draws in an external air from the outside by means of a suction force of a suction motor of the vacuum cleaner, that is, an air suction force in the second air flowing passage 124' and thus rotates the impeller 136, is mounted to a rotating part-mounting part 161 of the generator bracket 160.

The rotation driving-passage part 190 is made up of a plurality of suction openings 193 formed in a spaced-apart relation to one another on an outer circumferential surface of the rotating part-mounting part 161, a rotating part-mounting space 194 located in the rotating part-mounting part 161 in which the impeller 136 is disposed, and a discharging tube part 196 disposed on an upper surface of the rotating part-mounting part 161 to communicate with the second air flowing passage 124'. At this time, the discharging tube part 196 is formed in a reverse L-lettered shape, so that the rotating axis 137 of the impeller 136 is disposed parallel to the suction air flowing direction of the second air flowing passage 124'.

The electric generator 155, which generates an electric power to operate the detecting sensor 125 and the lamp part 145, is disposed to rotate by means of the impeller 136. For this, the axis of the electric generator 155 is connected to the rotating axis 137 of the impeller 136. The electric generator 155 may be formed of a known electric generator having a coil part, which is installed on the axis thereof between an N-polar magnet and an S-polar magnet, so that it can generate a voltage of 15V when the impeller 136 is rotated at a speed of, for example, 4300 revolutions per minute (rpm). To supply the generated electric power to the lamp part 145 and the detecting sensor 125, the coil part of the electric generator 155 is connected to the circuit board 147 on which the lamp part 145 is mounted. The lamp part 145 and the detecting sensor 125 are electrically connected to the circuit board 147. Alternatively, to use the electric power generated by the electric generator 155 as a power source for driving a power or circuit part of the operating handle 130, the circuit board 147 can be configured, so that it is electrically connected with the circuit part of the operating handle 130 by an electric wire or connector, which is not illustrated.

The cover part 150 is made up of an upper cover 151 and a lower cover 153. The upper cover 151 is formed to wrap the entire of part-mounting area of the body 114 on which the detecting sensor 125, the lamp part 145, the rotating part 135, the electric generator 155, etc. are installed. The upper cover 151 is fixed to the body 114 by fixing means, such as screws, etc. A transparent plate 151 is disposed on an upper side of the upper cover 151, and a plurality of air suction openings 151*a* is formed on the middle of the upper cover 151 to draw in the external air by the air suction force in the second air flowing passage 124'.

The lower cover 153 is formed to wrap a non-part-mounting area of the body 114 on which a muffler part 131 to be described later is formed. The lower cover 153 is fixed to the body 114 by fixing means, such as screws, etc.

To reduce noises generating when the impeller 136 is rotated and when the external air drawn in through the air suction openings 151*a* is mixed with air in the second air flowing passage 124' through the rotation driving-passage part 190, as illustrated in FIGS. 2 and 3, a muffler part 131 is formed in the non-part-mounting area of the body 114. The muffler part 31 is made up of a plurality of resonating holes 133, and a noise-absorbing member 134, such as a sponge. The resonating holes 133 are formed in predetermined shape and arrangement, for example, a latticed or zigzagged arrangement in the form of an oval in the non-part-mounting area of the body 114. The noise-absorbing member 134 is filled in a space in the non-part-mounting area, which is isolated from the outside and the part-mounting area by a partition of the body 114 and the lower cover 153. With this configuration, the noises generating when the impeller 136 is rotated and when the external air drawn in through the rotation driving-passage part 190 by the air suction force of the second air flowing passage 124' is mixed with the air in the second air flowing passage 124' are first removed by the noise-absorbing member 134 or the resonating holes 133, and then secondly diminished and vanished by the resonating holes 133 or the noise-absorbing member 134.

To detachably fix the connecting tube 120 constructed as described above between the suction nozzle 110 and the operating handle 130, the body 114 at a lower end thereof and the straight tube 113 at an upper end thereof have first and second connectors 115 and 119, respectively. The first connector 115 is formed of a cylindrical tube having a diameter smaller than that of a first corresponding connector 110*a* (see FIG. 7) of the suction nozzle 110, so that it can be inserted into the first corresponding connector 110*a*. The first connector 115 at a lower end thereof has a first flexible protrusion 117, which is inserted into a first fixing groove 110*a'* in the first corresponding connector 110*a* when it is connected with the first corresponding connector 110*a*. When the first connector 115 is separated from the first corresponding connector 110*a*, the first flexible protrusion 117 is pushed by a first button 110*a"* of the first corresponding connector 110*a* and thus easily slipped out from the first fixing groove 110*a'*. Like the first connector 115, the second connector 119 is formed of a cylindrical tube having a diameter larger than that of a second corresponding connector (not illustrated) of the operating handle 130, so that it can accommodate the second corresponding connector. On the second connector 119 are formed a second fixing groove 122 (see FIG. 1) and a second button 121. The second fixing groove 122 accommodates a second flexible protrusion (not illustrated) formed on the second corresponding connector when the second connector 119 is connected with the second corresponding connector. The second button 121 has a pushing part 121' (see FIG. 3), which elastically pushes down the second flexible protrusion inserted into the second fixing groove 122, so that the second flexible protrusion is easily slipped out from the second fixing groove 122, when the second connector 119 is separated from the second corresponding connector.

In the above description, although the connecting tube 120 having the dust sensing function according to the exemplary embodiment of the present disclosure is illustrated and explained as applied to the connecting tube having the tube element 111 made up of the straight tube 113, the present disclosure is not limited thereto. For instance, it goes without saying that the connecting tube 120 is applicable to a connecting tube in which the tube element 111 is formed of a telescopic tube (not illustrated) telescopically foldable, or a suction hose in which the tube element 111 is formed of a flexible hose or tube, in the same construction and principle. If the he connecting tube 120 is applied to the suction hose, the suction hose is detachably fixed between the operating handle 130 and the cleaner body 150 through first and the second connectors 115 and 119 and first and second corresponding connectors (not illustrated) of the operating handle 130 and the cleaner body 150.

Hereinafter, a dust sensing operation of the cleaner body 100 with the connecting tube 120 having the dust sensing function according to the exemplary embodiment of the present disclosure constructed as described above will be explained in detail with reference to FIGS. 1 through 7.

First, to clean dust or dirt adhered to the surface to be cleaned, as illustrated in FIG. 7, a user turns on the vacuum cleaner 100 while bring the suction nozzle 110 in contact with the surface to be cleaned. Then, a suction motor (not illustrated) in the motor chamber of the cleaner body 150 is operated, so that it generates a suction force. As a result, air is drawn in along with dust or dirt through an air inlet (not illustrated) of the suction nozzle 110. The air drawn in along with the dust or dirt through the air inlet flows into the second air flowing passage 124' of the body 114 and then the first air flowing passage 124 of the straight tube 113 of the connecting tube 120, and flows into the cleaner body 150 through the operating handle 130 and the suction hose 140, so that the dust or dirt is separated from the air in the dust collecting chamber, and then discharged to the outside.

Figure 6A:
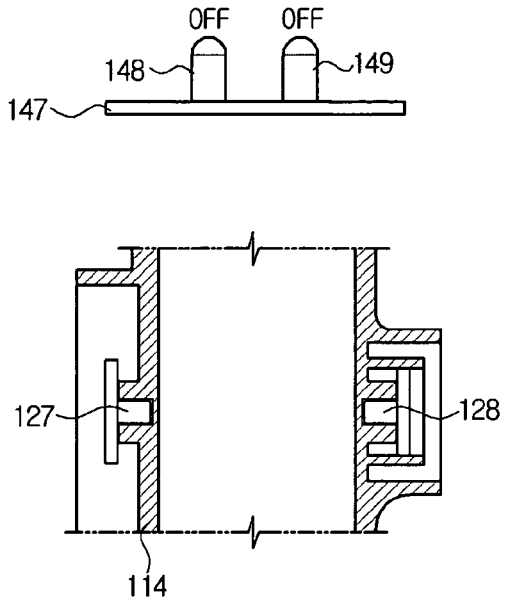
FIGS. 6A, 6B and 6C are partial cross-sectional views exemplifying operations of a detecting sensor and a lamp part of a dust sensing unit of the connecting tube illustrated in FIGS. 2 and 3.
Figure 6B:
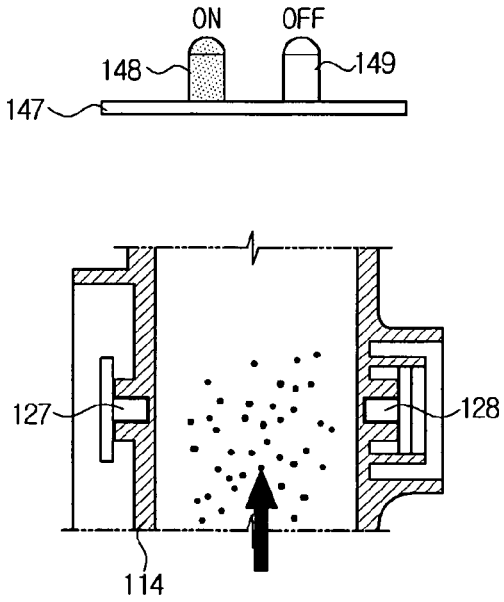
Figure 6C:
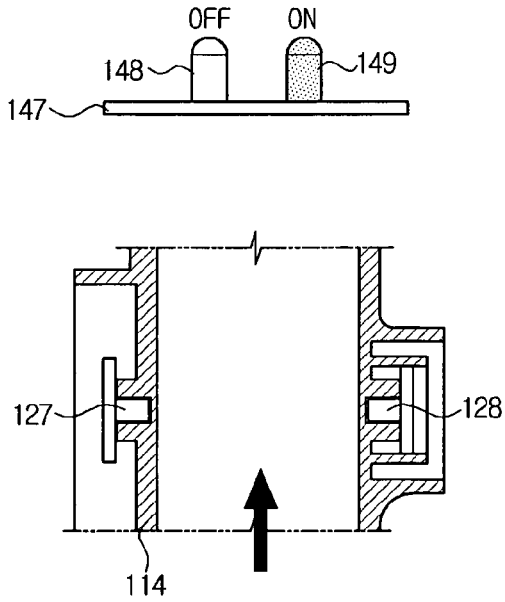

At this time, the impeller 136 of the rotating part 135 is rotated by an external air, which is drawn in through the suction openings 193 of the rotation driving-passage part 190 and the air suction openings 151*a* of the upper cover 151 from the outside due to the suction force of the suction motor of the vacuum cleaner, that is, an air suction force in the second air flowing passage 124'. As a result, the axis of the electric generator 155 connected to the rotating axis 137 of the impeller 136 is rotated, so that the electric generator 155 generates an electric power by the coil part thereof, which is rotated along with the axis thereof. The electric power generated from the electric generator 155 is transmitted to the detecting sensor 125 and the lamp part 145 through the circuit board 147. As the electric power is supplied to the detecting sensor 125, the light-emitting part 127 of the optical sensor 126 of the detecting sensor 125 emits light. Accordingly, when the dust or dirt passes between the light-emitting part 127 and the light-receiving part 128, the optical sensor 126 generates an OFF signal because the light-receiving part 128 does not receive the light emitted from the light-emitting part 127 due to the blockage of the dust or dirt. To the contrary, when the dust or dirt does not pass between the light-emitting part 127 and the light-receiving part 128, the optical sensor 126 generates an ON signal because the light-receiving part 128 receives the light emitted from the light-emitting part 127. At this time, the lamp part 145 installed on the circuit board 147 turns on the first lamp 148 to generate red light when the optical sensor 126 generates the OFF signal, as illustrated in FIG. 6B, and turns on the second lamp 149 to generate blue light when the optical sensor 126 generates the ON signal, as illustrated in FIG. 6C. As a result, the user can perceive whether there is a plenty of dust or dirt on the surface to be cleaned according to the time or frequency, which generates the red light or the blue light.

After that, when the cleaning operation is completed, the vacuum cleaner 100 stops operating. Then, the air is not moved through the second air flowing passage 124', so that the impeller 136 of the rotating part 135 is not rotated and thus the electric generator 155 does not generate the electric power. As a result, both the first and the second lamps 148 and 149 of the lamp part 145 is turned off, as illustrated in FIG. 6A.

As apparent from the foregoing description, according to the exemplary embodiment of the present disclosure, the connecting tube having the dust sensing function for use in the vacuum cleaner has the muffler part disposed in the body, so that the noises generating when the rotating part is rotated and when the external air is mixed with the air in the body are efficiently reduced. Accordingly, the connecting tube having the dust sensing function according to the exemplary embodiment of the present disclosure can automatically detect whether there is the dust or dirt on the surface to be cleaned and inform the user of the detected result without generating large noise in cleaning.

Although representative embodiment of the present disclosure has been shown and described in order to exemplify the principle of the present disclosure, the present disclosure is not limited to the specific exemplary embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A connecting tube having a dust sensing function for use in a vacuum cleaner, comprising:

a tube element having a first air flowing passage therein to move suction air laden with dust or dirt;

a body connected to the tube element and having a second air flowing passage to communicate with the first air flowing passage;

a detecting sensor disposed in the second air flowing passage of the body to detect whether the dust or dirt passes through the second air flowing passage;

a lamp part to operate according to a signal outputted from the detecting sensor;

a rotating part rotatably disposed in the body;

a rotation driving-passage part disposed in the body to draw in an external air into the second air flowing passage from the outside by means of an air suction force in the second air flowing passage of the body and thus to rotate the rotating part;

an electric generator connected to the rotating part to rotate by the rotating part thus to generate an electric power for operating the detecting sensor and the lamp part;

a muffler part disposed in the body to reduce noises generating in rotating of the rotating part and in flowing of air in the second air flowing passage; and a cover part to wrap an area of the body on which the detecting sensor, the lamp part, the rotation driving-passage part, the electric generator, and the muffler part are installed, wherein the muffler part comprises:

a plurality of resonating holes formed in the body adjacent to the second air flowing passage; and a sponge filled in a space between the cover part and the body on the plurality of resonating holes.

2. The connecting tube of claim 1, wherein the tube element comprises an element selected from the group consisting of a straight tube, a telescopic tube, and a flexible tube.

3. The connecting tube of claim 1, wherein the body and the tube element are detachably disposed on a suction nozzle and an operating handle, or the operating handle and a cleaner body, respectively.

4. The connecting tube of claim 1, wherein the detecting sensor comprises an optical sensor having a light-emitting part and a light-receiving part.

5. The connecting tube of claim 1, wherein the lamp part comprises:

a first lamp to operate according to a first signal generated when the detecting sensor detects the dust or dirt; and a second lamp to operate according to a second signal generated when the detecting sensor does not detect the dust or dirt.

6. The connecting tube of claim 1, wherein the rotating part comprises an impeller having a rotating axis disposed parallel to a longitudinal axis of the second air flowing passage of the body.

7. The connecting tube of claim 1, wherein the rotation driving-passage part comprises a rotating part-mounting part configured to mount the rotating part therein, and comprises a plurality of suction openings formed on an outer circumferential surface of the rotating part-mounting part to draw in the external air, a rotating part-mounting space in which the rotating part is disposed and through which the external air moves via the rotating part, and a discharging tube part formed on a surface of the rotating part-mounting part to communicate with the second air flowing passage.

8. The connecting tube of claim 1, wherein the cover part comprises an upper cover and a lower cover, the upper cover wrapping the area of the body, the upper cover comprising a transparent plate and a plurality of air suction openings.

* * * * *